United States Patent [19]

Ferreira de Abreu

[11] Patent Number: 4,886,099

[45] Date of Patent: Dec. 12, 1989

[54] WOODWORKING MACHINE WITH FEEDING SYSTEM

[75] Inventor: Alfredo Ferreira de Abreu, Trofa, Portugal

[73] Assignee: Mida—Máquinas Industriais do Ave, Lda., Trofa, Portugal

[21] Appl. No.: 233,805

[22] Filed: Aug. 19, 1988

[30] Foreign Application Priority Data

Dec. 15, 1987 [PT] Portugal ..... 86372

[51] Int. Cl.[4] ..... B27C 1/02

[52] U.S. Cl. ..... 144/117 R; 144/246 R; 144/246 E; 144/249 R

[58] Field of Search ..... 198/624, 817, 836; 144/114 R, 116, 117 R, 117 B, 245 P, 246 R, 246 D, 246 E, 247, 248, 249 R

[56] References Cited

U.S. PATENT DOCUMENTS

| | | | |
|---|---|---|---|
| 544,121 | 8/1895 | Pugh | 144/117 R |
| 677,243 | 6/1901 | Luther | 144/246 R |
| 899,143 | 9/1908 | Thomas et al. | 144/247 |
| 1,736,641 | 11/1929 | Zimmerman | 144/117 R |
| 2,613,706 | 10/1952 | Smith | 144/248 |
| 2,687,153 | 8/1954 | Moore | 144/117 P |
| 2,694,424 | 11/1954 | Buss | 144/249 R |
| 3,718,168 | 2/1973 | Berends | 144/117 R |

OTHER PUBLICATIONS

Multisided planing machines, Kupfermühle Holztechnik GmbH, 1981.

Heavy duty planers, Kupfermühle Holztechnik GmbH, 1985.

Four-sides moulding machine models M, Argemi Constructores, 1978.

Multisided Plaining [sic] Machines MLF, Máquinas Penheiro, Lda., undated.

Planing and routing machines with 2-3-4 shafts Ultra Olon 400, undated.

*Primary Examiner*—W. Donald Bray

*Attorney, Agent, or Firm*—Goodman & Teitelbaum

[57] ABSTRACT

The feeding system comprises feed rollers intended for the automatic delivery, advance, and ejection of workpieces. The feed rollers are all driven jointly by a single drive facility via various belt or chain drives; they all have the same peripheral speed and rotate synchronously with an upper cutting head which is driven by the same drive facility. The feed rollers include delivery rollers disposed before the cutting head and upper and lower ejection rollers disposed after the cutting head. The lower ejection rollers are connected to a vertically adjustable feed table. None of the feed rollers need be displaced for adjusting the woodworking machine to different dimensions of workpieces, and the synchronization of the feed rollers and cutting head yields workpieces with uniformly smoothly machined surfaces.

10 Claims, 4 Drawing Sheets

WOODWORKING MACHINE WITH FEEDING SYSTEM

This invention relates to woodworking equipment, and more particularly a woodworking machine, especially for planing and/or milling workpieces on one or more sides, of the type having a feed table, at least one cutting head, and a feeding system including cylindrical feed rollers.

Woodworking machines having feeding systems of the foregoing type for delivering, advancing, and ejecting workpieces are commercially available. However, the individual feed rollers are often so disposed that it is complicated and time-consuming to reset the machine when processing workpieces of different dimensions, so that the downtime of the machine is substantial. In order to keep this changeover time within reasonable limits, some of the feed rollers of the prior art machines are often not driven, are only optional equipment, or are relatively far from the cutting heads. As a result, machined workpieces are either not automatically ejected or the minimum processing length of a workpiece must be relatively great in order to achieve automatic ejection.

It is therefore an object of this invention to provide a woodworking machine with an improved feeding system which does not have the above drawbacks.

To this end, in the woodworking machine according to the present invention, of the type initially mentioned, the feed rollers intended for the automatic delivery, advance, and ejection of workpieces each have at least one delivery roller, an upper ejection roller, and a lower ejection roller, there is at least one drive means for driving all the feed rollers, the upper ejection roller is disposed swivellably about a driving shaft and displaceably thereon transversely to the feed table, and the lower ejection roller is rotatably mounted in the feed table and vertically adjustable jointly with the latter.

Figures 1A, 1B:
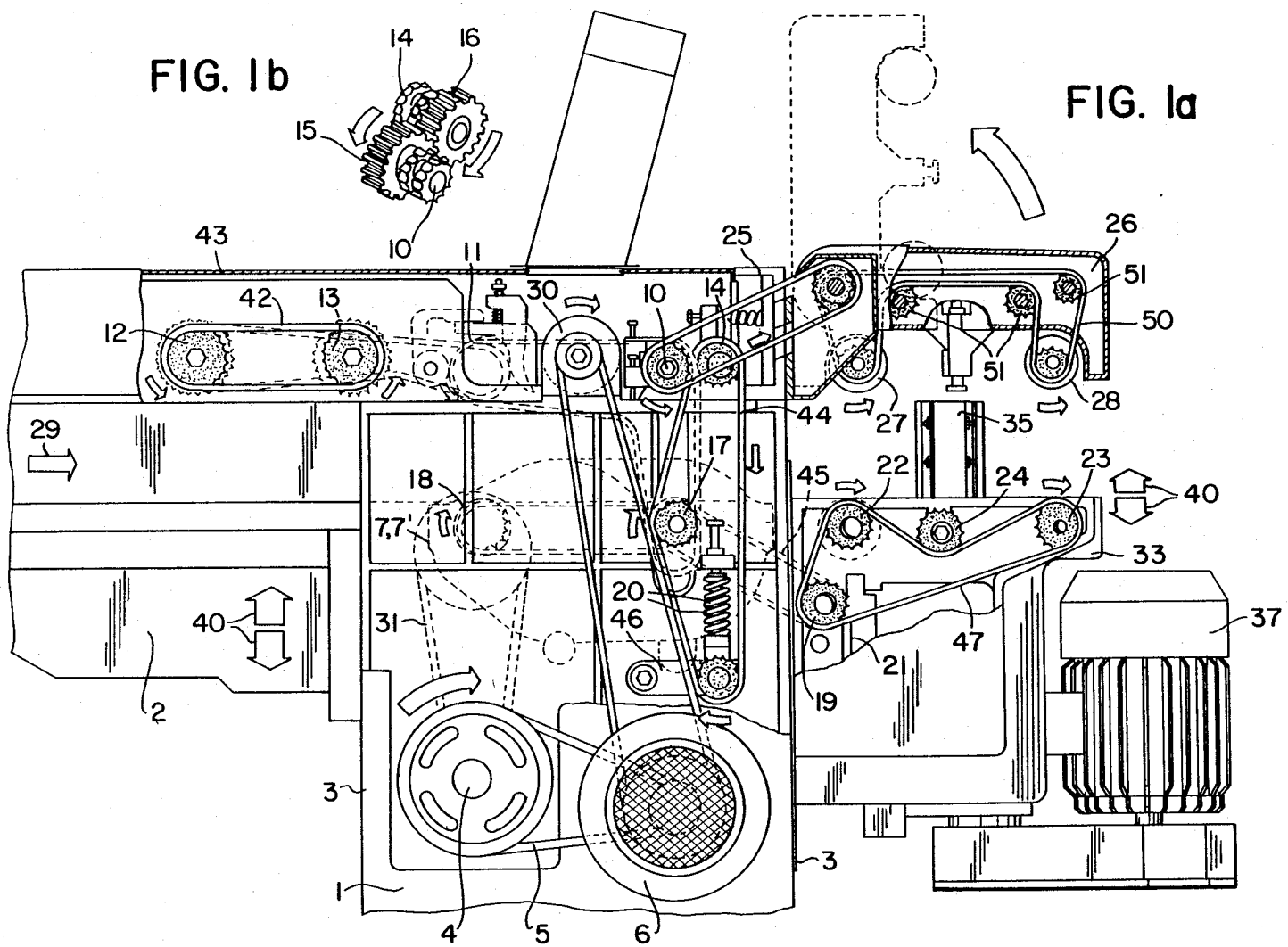
Figure 2:
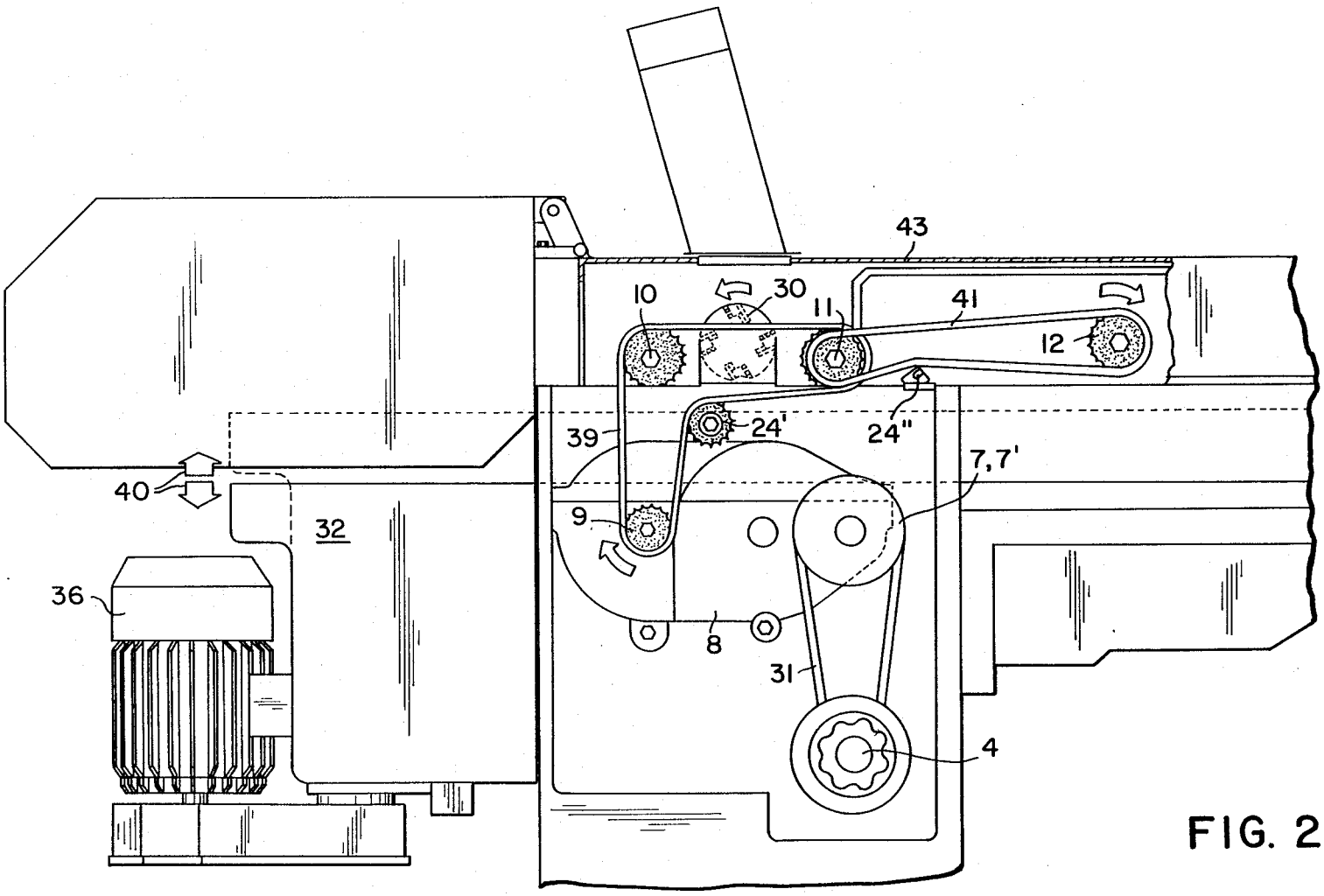
Figure 3:
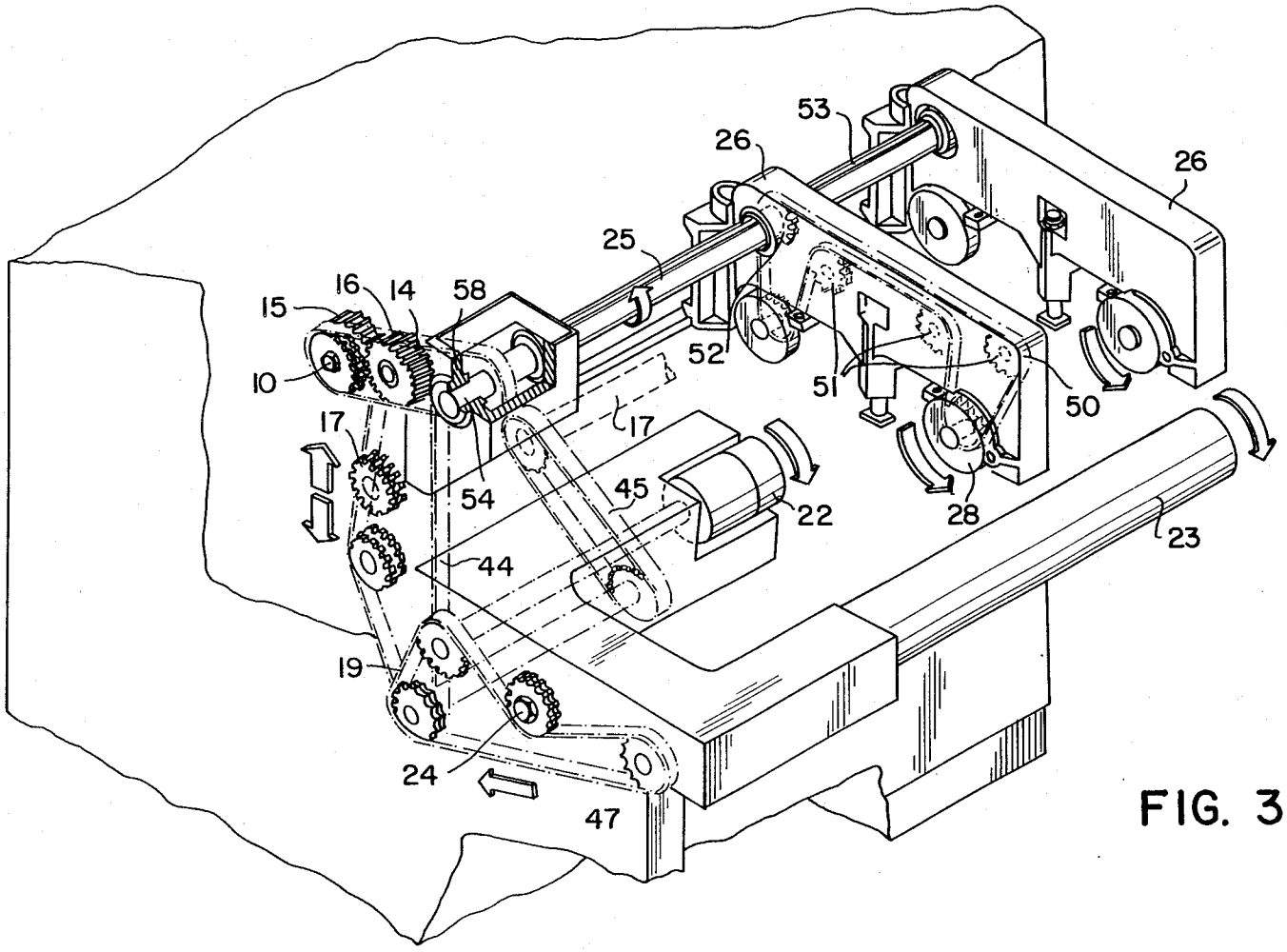
Figure 4:
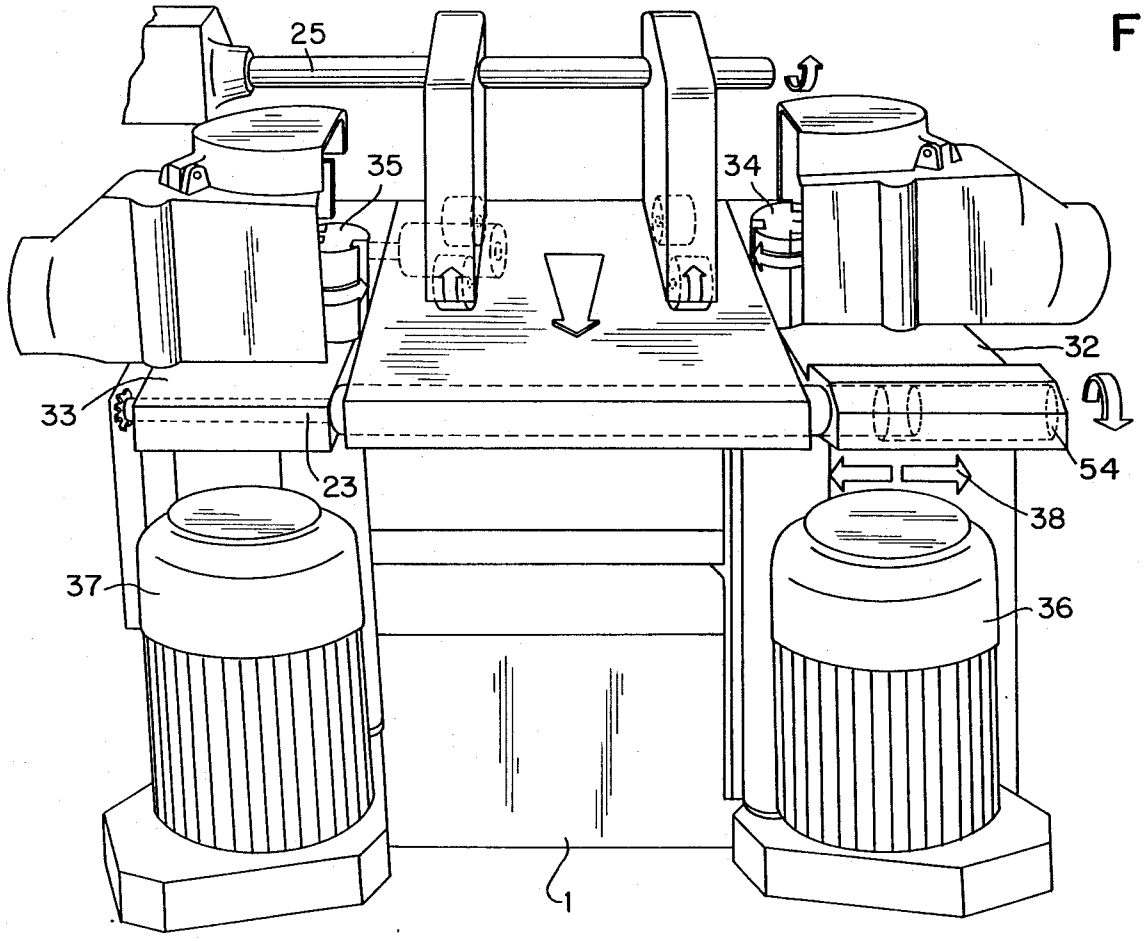

A preferred embodiment of the invention will now be described in detail with reference to the accompanying drawings, in which:

FIG. 1*a* is a side elevation of a woodworking machine equipped with the inventive feeding system, parts of the housing being removed, FIG. 1*b* is an enlarged perspective view showing the means for rotating the shaft 14 shown in FIG. 1*a*, FIG. 2 is an elevation of the other side of the machine, parts of the housing likewise being removed, FIG. 3 is a partial perspective view of the machine with parts of the housing removed, showing the main parts of the feeding system, and FIG. 4 is a rear elevation of the machine equipped with the feeding system.

As illustrated in FIG. 1*a*1*b* and 2, the machine comprises a frame 1 having disposed thereon a feed table 2 intended as a support surface for workpieces during their delivery, advance, machining, and ejection. The workpieces are fed in the direction indicated by arrow 29. The feed table 2 is secured to slideways 3 for vertical displacement as indicated by arrows 40. Mounted in the machine frame 1 is an electric motor 6 for driving both an upper cutting head 30 and a feeding system comprising feed rollers 10–13, 22, 23, 27, and 28. A first spindle 4, driven via a first chain drive 5, transmits its rotary motion on the left-hand side—viewed from in front of the machine—via a V-belt drive 31 to adjusting means 7, 7' coupled to the primary shaft of gearing 8 (cf. FIG. 2) for adjusting the peripheral speed of the feed rollers 10, 12, 13, 22, 23, 27, 28. The adjusting means 7, 7' comprise essentially two frustoconical rollers which are provided with recesses and, axially meshing, are displaceable. The V-belt drive 31 passes between these rollers. The output shaft of the gearing 8 transmits its rotary motion via a second chain drive 39 to the feed rollers 10 and 11. From the feed roller 11 there is a third chain drive 41 for transmitting the rotary motion to a further feed roller 12 from which, by means of a fourth chain drive 42, a feed roller 13 disposed between the feed rollers 11 and 12 is driven. All of the feed rollers 10–13 just mentioned extend over the whole width of the machine. Designating the rollers situated before the upper cutting head 30, in the feed direction 29 of a workpiece, as delivery rollers, and the feed rollers disposed after the workpiece as ejection rollers, then the feed rollers 11, 12, and 13 are delivery rollers and the feed roller 10 is a first ejection roller. The outside surface of the cylindrical feed rollers may be either corrugated or smooth. In order that even very short workpieces may be automatically delivered and ejected, feed rollers must be disposed immediately before and after the cutting heads. By means of the inventive feeding system, this is admirably accomplished inasmuch as workpieces having a minimum length of only 300 mm can be automatically machined. Because the cover 43 can be swung up, access to the upper cutting head 30 is ensured.

As may be seen from FIGS. 1*a*, 1*b* and 3, the feed roller 10 transmits its rotary motion via adjacent intermediate gears 15, 16, for reversing the direction of rotation, to a shaft 14. A fifth chain drive 44, revolving with the shaft 14, drives a gearwheel 19 and a spindle 17. The spindle 17 is the first spindle mounted on the feed table 2 and is vertically adjustable therewith. The gearwheel 19 has a swivel mounting 46 and a compression spring 20 for keeping the chain of the fifth chain drive 44 taut upon vertical adjustment of the feed table 2. By means of a sixth chain drive 45, the spindle 17 further transmits its rotary motion to another spindle 21, from which a seventh chain drive 47 drives the rRs 22 and 23. The latter, as lower ejection rollers, are mechanically connected to the vertically adjustable feed table 2.

FIG. 4 shows how, on the ejection side of the machine, the feed table 2 is designed as two side tables 32 and 33, one disposed on each side of the longitudinal axis of the machine. Each of the side tables 32, 33 has a vertical cutting head 34, 35 driven by a respective drive motor 36, 37 for machining the lateral surfaces of a workpiece passing between these side tables. The side table 33 is provided for supporting the lower ejection rollers 22, 23 and the spindle 21. The side table 32 is laterally displaceable in the direction indicated by arrow 38 for adjusting the machining width of a workpiece. The ejection roller 23, extending over the entire processing width, is supported for axial displacement in a bore 49 in the laterally displaceable side table 32.

Returning to FIGS. 1*a*, 1*b* and 3, it will be seen that via an eighth chain drive 48, the feed roller 10 rotates a driving shaft 25 extending over the entire width of the machine. The shaft 25 is rotatingly mounted at each of its ends in bearing means 54 disposed on the machine frame 1. One or more pressing units 26 are disposed on and slidable along the shaft 25. Each of the pressing units 26 bears two upper ejection rollers 27, 28 disposed in tandem in the feed direction indicated by arrow 29 in FIG. 1*a*. The rollers 27, 28 are connected via a ninth chain drive 50 to a gearwheel 52 driven by the shaft 25. This gearwheel includes a groove engaged by a key 53 disposed on the shaft 25 for transmitting the torque. Further disposed in the pressing units 26 are deviating gearwheels 51 for the necessary deviation of the chain drive 50. Each of the pressing units 26 is pivotable about the shaft 25, firstly in order to exert upon the top of a workpiece being machined the pressure necessary for ejecting it, and secondly in order to ensure good accessibility to the ejection opening when the machine is at a standstill by swinging the pressing units up. Because the units 26 are displaceable along the shaft 25, the active locations of the ejection rollers 27 and 28 can be adapted to the width of a workpiece. In the longitudinal direction of the machine, the ejection rollers are disposed so that the upper and lower ejection feed rollers 27, 28 and 22, 23 are situated substantially opposite one another. The workpiece is thereby held fast between the upper and lower ejection rollers and optimally conveyed by means of the forces acting upon it.

All of the aforementioned gearwheels, spindles, and shafts driven by the various belt or chain drives 5, 31, 39, 41, 42, 44, 45, 47, 48, 50 are so dimensioned that the peripheral speed of all the feed rollers 11, 12, 13, 10, 22, 23, 27, 28 is the same. All the feed rollers are driven by the electric motor 6, which at the same time also drives the upper cutting head 30 in the opposite direction from the feed rollers. Synchronization between the speeds of rotation of the feed rollers and of the upper cutting head is thereby achieved. Slowing down of the upper cutting head, e.g., owing to irregularities in the wood being machined, such as knots and-the like, brings about a comparable decrease in the speed of the feed rollers. In this way, uniform fineness of the processed surface of the workpiece is obtained.

Chain tighteners 24, 24', and 24" are provided for adjusting the tension of the various chains.

Instead of chain drives, it would also be possible to use belt drives, e.g., toothed belts.

In another embodiment, the feeding system might be driven by its own electric motor, which would then not drive the upper cutting head as well.

Inasmuch as the lower feed rollers 22, 23 are connected to the vertically adjustable feed table 2 and are mounted only in one side table 33, whereas the other side table 32 is laterally displaceable, the machining dimensions of various workpieces can be adjusted extremely quickly without having to displace feed rollers. Hence the downtime of the machine is correspondingly short. The feeding system is so designed that even workpieces two meters or more in width can be delivered, advanced, and ejected with no problem.

Since no feed rollers need be displaced for adjusting the machining dimensions of different workpieces, a machine equipped with the inventive feeding system is suited for computer-controlled setting of the dimensions of the workpieces to be machined.

What is claimed is:

1. A woodworking machine, especially for planing and/or milling workpieces on one or more sides, of the type having a vertically adjustable feed table, at least one cutting head, and a feeding system including a plurality of cylindrical feed rollers, wherein the improvement comprises:

at least one drive means for driving all said feed rollers, a driving shaft disposed transversely to said feed table, at least two delivery feed rollers disposed before said cutting head, at least two upper ejection feed rollers mounted swivellingly about and displaceably along said driving shaft, and at least two lower ejection feed rollers rotatingly mounted in said feed table and vertically adjustable jointly therewith.

2. The woodworking machine of claim 1, wherein all said feed rollers have the same peripheral speed.

3. The woodworking machine of claim 1, wherein said drive means include a single electric motor.

4. The woodworking machine of claim 1, wherein said drive means include an electric motor for jointly driving an upper said cutting head and said feed rollers, the speed of rotation of said upper cutting head and of said feed rollers being synchronized.

5. The woodworking machine of claim 4, further comprising means for setting the peripheral speed of said feed rollers.

6. The woodworking machine of claim 1, further comprising a plurality of transmission drives for transmitting the rotary motion of said drive means to said feed rollers.

7. The woodworking machine of claim 1, further comprising at least two pressing units disposed swivellingly about and displaceably along said driving shaft, said two upper ejection feed rollers being respectively integrated in said pressing units, and said upper and lower ejection feed rollers being respectively disposed substantially opposite one another for exerting oppositely directed pressure on an advancing workpiece.

8. The woodworking machine of claim 1, wherein the surfaces of said feed rollers are corrugated.

9. The woodworking machine of claim 1, wherein the surfaces of said feed rollers are smooth.

10. The woodworking machine of claim 1, comprising two vertical said cutting heads, said feed table comprising at the ejection end of said woodworking machine two side tables for respectively receiving said two vertical cutting heads, said lower ejection feed rollers being mounted and driven in at least one of said side tables, and the other of said side tables being displaceable a right angles to said feed table for adjusting the machining width of a workpiece.

* * * * *